US009318286B2

(12) United States Patent
Devarajan et al.

(10) Patent No.: US 9,318,286 B2
(45) Date of Patent: Apr. 19, 2016

(54) POINT LEVEL FLOAT SWITCH WITH OPPOSITE POLARITY MAGNETS

(71) Applicant: CATERPILLAR INC., Peoria, IL (US)

(72) Inventors: Ganeshram Muthusamy Devarajan, Peoria, IL (US); Amiyo K. Basu, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 161 days.

(21) Appl. No.: 14/147,054

(22) Filed: Jan. 3, 2014

(65) Prior Publication Data

US 2015/0194282 A1 Jul. 9, 2015

(51) Int. Cl.
*H01H 36/02* (2006.01)
*H01H 35/18* (2006.01)

(52) U.S. Cl.
CPC ..... *H01H 35/18* (2013.01); *Y10T 29/49105* (2015.01)

(58) Field of Classification Search
CPC ..... H01H 36/02; H01H 35/00; H01H 35/02; H01H 35/022; H01H 35/18; H01H 35/186; H01H 36/00; H01H 36/0006; H01H 36/0073; H01H 2231/038; H01H 2239/024; G01F 1/28
USPC ..... 200/52 R, 56 R, 61.04, 61.2, 61.39, 200/61.53, 61.45 M; 335/2, 15, 29, 38, 49, 335/51, 52, 54, 56, 69, 75, 80, 82, 92, 335/95–97, 177, 180–183, 229, 306
See application file for complete search history.

(56) References Cited

U.S. PATENT DOCUMENTS

| | | | | |
|---|---|---|---|---|
| 3,781,498 | A | 12/1973 | Kamil et al. | |
| 4,056,979 | A * | 11/1977 | Bongort et al. | 73/313 |
| 4,165,935 | A * | 8/1979 | Bongort et al. | 335/207 |
| 4,191,151 | A * | 3/1980 | Wanamaker | 123/694 |
| 4,748,299 | A | 5/1988 | Custer | |
| 5,021,619 | A * | 6/1991 | Hutchinson | 200/81.9 M |
| 5,767,419 | A * | 6/1998 | Hutchinson | 73/861.74 |
| 6,813,946 | B1 | 11/2004 | Benton | |
| 8,261,613 | B2 | 9/2012 | Husain | |
| 2009/0224929 | A1 | 9/2009 | Harper | |
| 2010/0132455 | A1 | 6/2010 | Boehmer | |
| 2011/0138907 | A1 | 6/2011 | Rudd et al. | |

FOREIGN PATENT DOCUMENTS

| | | | |
|---|---|---|---|
| JP | 09105653 | | 4/1997 |
| JP | 2008157675 | | 7/2008 |
| JP | 2008157675 | A * | 7/2008 |

* cited by examiner

*Primary Examiner* — Renee Luebke
*Assistant Examiner* — Anthony R. Jimenez
(74) *Attorney, Agent, or Firm* — Edward Lin

(57) ABSTRACT

A point level float switch is provided. The point level float switch includes a switch, a removable shaft, and a float. The removable shaft includes a first magnet aligned with the switch. The float is arranged to enclose at least a portion of the removable shaft. The float includes a second magnet of a polarity opposite to the first magnet and arranged parallel to the first magnet in the removable shaft.

20 Claims, 5 Drawing Sheets

POINT LEVEL FLOAT SWITCH WITH OPPOSITE POLARITY MAGNETS

TECHNICAL FIELD

This patent disclosure relates generally to fluid level detectors and, more particularly, to a passive point level float switch with opposite polarity magnets.

BACKGROUND

Conventional horizontal float switches for fluid level detection have a hinged plastic float that rotates up or down around a hinge or a spin nut depending upon a changing level of a fluid. Such conventional float switches include a magnet to actuate a reed switch in a pivoted motion of the float, the magnet being located typically towards the end of the float assembly or housing of the float switch. For proper rotation based operation of such conventional float switches, the magnet and the reed switch have to be precisely oriented during installation, which is a difficult goal to achieve. The rotational motion of the hinged plastic float that moves up or down makes it prone to breakage, wear and tear of hinge holes, and misalignment, for example, in heavy machinery operations where there are substantial vibrational forces involved. Due to such wear and tear of the hinges caused by rotating float, the pivot motion angle of the float is altered resulting in low error tolerance, incorrect readings and false alarms. Further, such conventional design of the float switch requires an extended housing to accommodate the wide sweep of rotation of the float, using more space and material, and also need to be oriented in appropriate position for proper function.

Some conventional fluid level detectors employ sensor based techniques. However, such sensor based design substantially increases costs and complexity of the design due to the electronics involved. Further, such conventional sensor based fluid level detectors are power hungry as they deploy active devices. The electronics of the sensor based fluid level detectors is also prone to malfunctioning in harsh environments, for example, in high vibration, temperature or pressure operations. This increases parts replacement and warranty related costs.

U.S. Pat. No. 4,056,979 ('979 patent), entitled "LIQUID LEVEL SENSOR," is an example description of such a sensor based liquid level sensing device. The '979 patent purportedly is directed towards a liquid level sensor having a vertical guide tube with one or more magnetically operated switches therein at vertically spaced locations and a free float thereon which rises and falls with the liquid level and as it passes each switch magnetically latches it in one condition until the float returns in the opposite direction and unlatches it. The switches may be normally open, normally closed, or any combination, so that movement of the float past the switches may provide any desired circuit sequence.

However, the design discussed in the '979 patent is fixed in nature and needs the float to move over large distances with no options to realign the magnets of the float if they get misaligned. Accordingly, there is a need for an improved point level float switch.

SUMMARY

In one aspect, the disclosure describes a point level float switch. The point level float switch includes a switch, a removable shaft, and a float. The removable shaft includes a first magnet aligned with the switch. The float is arranged to enclose at least a portion of the removable shaft. The float includes a second magnet of a polarity opposite to the first magnet and arranged parallel to the first magnet in the removable shaft.

In another aspect, the disclosure describes a method of making a point level float switch. The method includes providing a switch, aligning with the switch, a first magnet inside a removable shaft, arranging a float enclosing at least a portion of the removable shaft, and providing a second magnet of a polarity opposite to the first magnet inside the float, the first and the second magnets being parallel.

In yet another aspect, the disclosure describes a housing for a point-level float switch. The housing includes a reed switch, a screwable shaft, and a float. The screwable shaft includes an embedded magnet therein aligned with the reed switch. The float is arranged to enclose at least a portion of the screwable shaft, the float including a second magnet of a polarity opposite to the first magnet and arranged parallel to the first magnet in the removable shaft.

DETAILED DESCRIPTION

Figure 1:
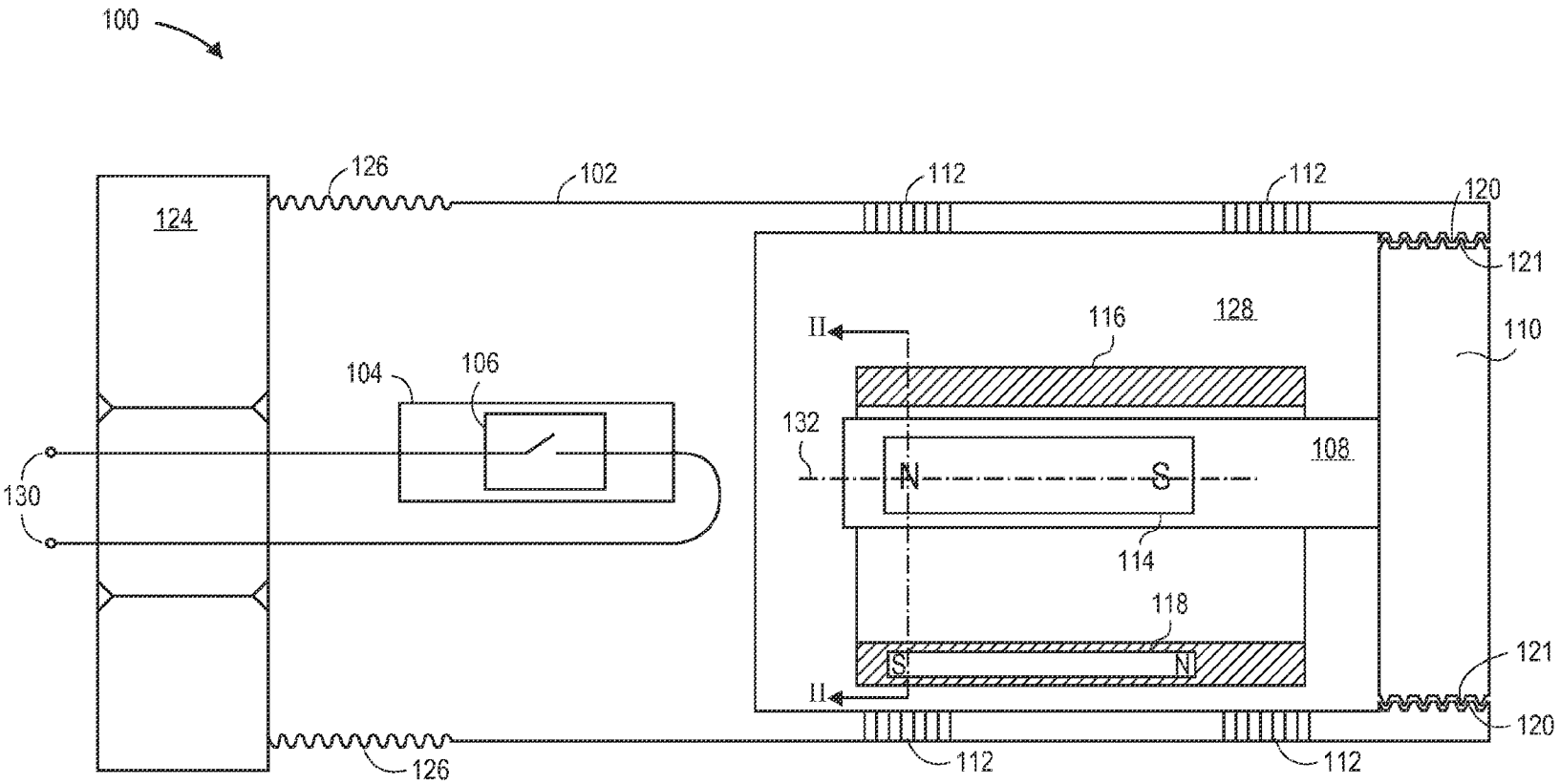
FIG. 1 illustrates a point level float switch, in accordance with an aspect of this disclosure.

Now referring to the drawings, wherein like reference numbers refer to like elements, there is illustrated a point level float switch 100 including a housing 102, a switch 104, a removable shaft 108 having a shaft head 110, and a float 116. By way of example only and not by way of limitation, the point level float switch 100 may be included inside a machine part or a machinery where a fluid level has to be determined, detected, or monitored. Further by way of example only and not by way of limitation, the machine part or machinery may be deployed in a harsh environment, in a construction zone, or other heavy machinery applications. For example, the machinery may be a dozer deployed in a mining environment and the point level float switch 100 may be deployed in a fuel or coolant tank of the dozer. In one aspect, the fluid may be a liquid, a gas, a mixture of liquids (miscible or immiscible), a mixture of gases (miscible, immiscible, reactive, or inert), or combinations thereof. In one aspect, the point level float switch 100 is passive deploying no active electronic or electrical components (e.g., batteries, transistor based switches, sensors, etc.). In one aspect, the point level float switch 100 and components thereof are arranged to be orientation independent. For example, with respect to relative orientations of the removable shaft 108 and the float 116, the point level float switch 100 is tolerant to variations or inaccuracies in the orientation of the housing 102, the removable shaft 108 and the float 116, as discussed, for example with respect to FIGS. 5 and 6.

In the cross-sectional view of the point level float switch 100 illustrated in FIG. 1, the housing 102 may be barrel shaped (cylindrical or with a polygonal cross section) made of metal, alloys, or a suitable hard material (e.g., hard plastic). In one aspect, the point level float switch 100 may include the switch 104 and the removable shaft 108 pushed into a volume 128 using the shaft head 110. In one aspect the housing 102 includes one or more openings 112 through which a fluid can enter or leave the volume 128. The one or more openings 112 may be continuous or may be perforations on a surface of the housing 102. In one aspect, the housing 102 includes a first set of threads 126 near a head 124. The first set of threads 126 may be configured in a predetermined thread pattern to screw the housing into a receiving unit (not shown). Such a receiving unit may be on a wall of a fuel tank at a certain level from a base of the fuel tank, for example. In one aspect, the housing 102 includes a second set of threads 120 near an opening or an entrance (not shown) to the volume 128 where the shaft head 110 is inserted. The second set of threads 120 may be configured in a predetermined thread pattern similar to or different from that of the first set of threads 126. In one aspect, the housing 102 may be shielded from external magnetic fields, such that any changes to magnetic fields out the point level float switch 100 does not affect the housing 102. In one aspect, a largest dimension of the housing 102 may range from 20 mm to 40 mm, or above.

The switch 104 is a magneto-responsive switch. The term "magneto-responsive" may be related to an element that changes a physical state based upon a change in a magnetic field applied thereto. Such change of state may be related to an open state ("OFF" state) or a closed state ("ON" state) of the switch 104. In one aspect, the switch 104 is a reed switch, e.g., provided by Meder Electronic Inc. of West Wareham, Mass. In one aspect, the switch 104 may be a Hall-effect switch, e.g., provided by Magnasphere Corporation of Waukesha, Wis., although other types of switches that respond to a change in surrounding magnetic field could be used. In one aspect, the switch 104 includes an element 106 and output terminals 130. In one aspect, the element 106 may be responsive to the change in a magnetic field surrounding the switch 104. For example, when the switch 104 is a reed switch, the element 106 may be a pair of cantilevered ferro-electric plates that may be separated or joined together to effectuate an OFF state or an ON state, respectively, of the switch 104. Accordingly, the switch 104 is configured to output over the output terminals 130 an electric, acoustic, or optical signal (not shown) to indicate a fluid level inside the volume 128, as discussed with reference to FIGS. 2-5.

In one aspect, the removable shaft 108 is a solid barrel including a first magnet 114 embedded therein. The removable shaft 108 may be integrally coupled to or may include the shaft head 110 with a third set of threads 121 at a periphery to match with the second set of threads 120 of the housing 102. The shaft head 110 may have perforations for the fluid in the volume 128 to pass through. In this respect, the removable shaft 108 is "removable" since the second set of threads 120 on the housing 102 and the third set of threads 121 on the shaft head 110 may be used to adjust a position of the removable shaft 108 from inside the volume 128 to outside the volume 128 of the housing 102, and everywhere in between. In some aspects, the presence of second set of threads 120 and the third set of threads 121 may be related to the removable shaft 108 being interchangeably referred to as the screwable shaft 108 when the removable shaft 108 is screwed to the housing 102, although other arrangements for removability of the removable shaft 108, e.g., latches, spring arrangements, sliders, and the like, or combinations thereof, may be used. Such removability of the removable shaft 108 and the adjustability in positions thereof may be used for aligning the first magnet 114 with respect to the switch 104. The third set of threads 121 may be configured in a predetermined thread pattern similar to, complementary to, or different from that of the first set of threads 126 and/or the second set of threads 120 for appropriate screwability of the removable shaft 108.

In one aspect, the first magnet 114 is oriented such that the north pole of the first magnet 114 is closer to the switch 104 than the south pole, as indicated by the letters 'N' and 'S', respectively. Alternatively, the first magnet 114 may be oriented in an opposite manner than that shown in FIG. 1, with respect to the polarity such that the north and the south poles are interchanged or opposite to the arrangement shown in FIG. 1. It is noted that the aspects of the disclosure are not dependent upon or limited by the individual polarity of the first magnet 114, rather on the polarity with respect to a second magnet 118 in the float 116. In one aspect, the first magnet 114 is a bar magnet. In one aspect, the first magnet 114 may be an array of magnets, e.g., an array of individual bar magnets, having an effective polarity similar to that for the first magnet 114 in FIG. 1. In one aspect, a position of the first magnet 114 inside the removable shaft 108 is fixed. For example, prior to insertion into the volume 128 of the housing, the first magnet 114 may be placed at a fixed position in the removable shaft 108. In one aspect, the first magnet 114 may be arranged around a major axis 132 such that a major axis (not shown) of the first magnet 114 may coincide with or is parallel to the major axis 132 of the removable shaft 108. In one aspect, the arrangement of the first magnet 114 is such that the first magnet 114 is aligned with a center line or a major axis of the switch 104. For example, the first magnet 114 may be aligned with the center line of a reed switch.

Figure 2:
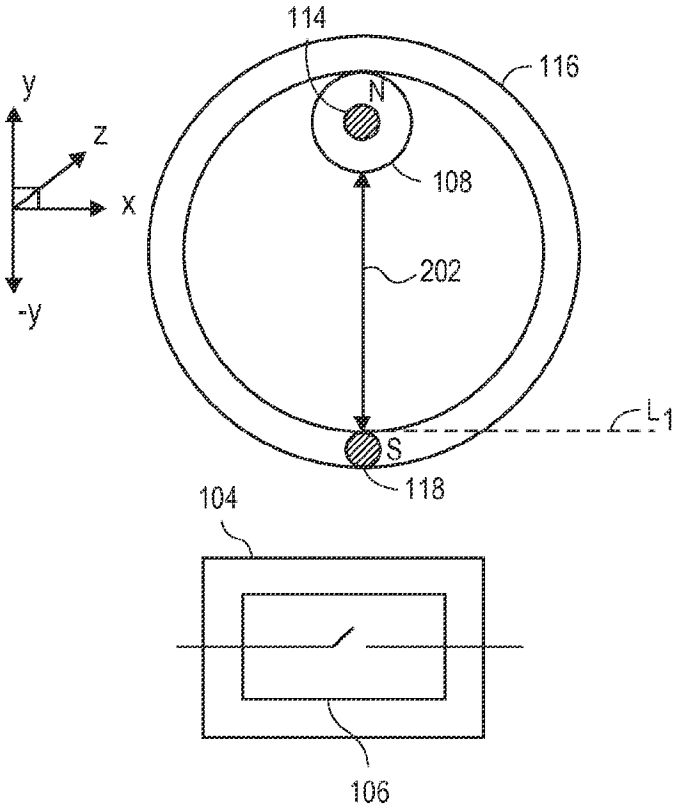
FIG. 2 illustrates a cross-sectional view of a portion of the point level float switch of FIG. 1 with a first state of a switch in the point level float switch, in accordance with an aspect of this disclosure.
Figure 3:
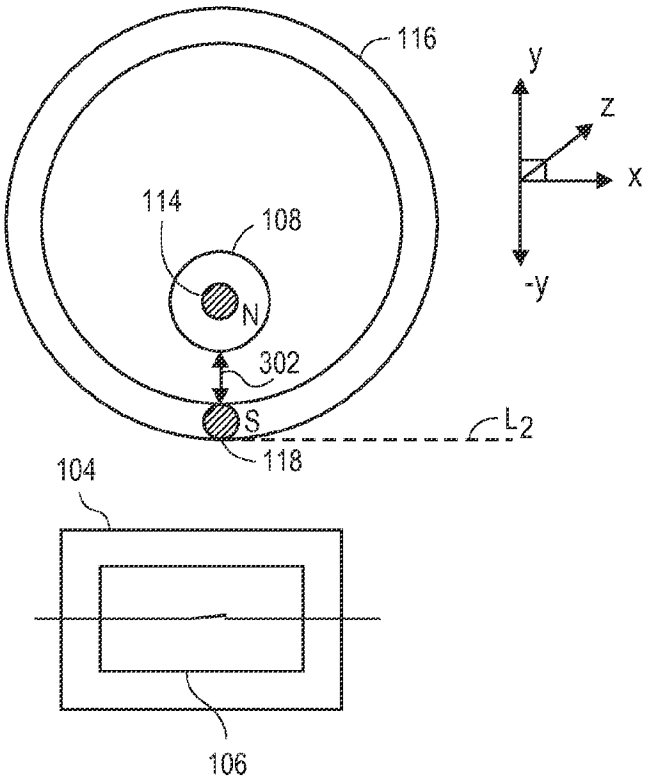
FIG. 3 illustrates a cross-sectional view of a portion of the point level float switch of FIG. 1 with a second state of the switch in the point level float switch, in accordance with an aspect of this disclosure.

In one aspect, the float 116 is a barrel shaped solid. The float 116 is arranged to at least partially cover the removable shaft 108. By way of example only and not by way of limitation, the float 116 may be a hollow cylinder with a ring-shaped cross-section as shown in FIGS. 2 and 3, into which the removable shaft 108 may be inserted. The float 116 may be made of a light or buoyant material, as known to those of ordinary skill in the art. For example, the float 116 may be made of plastic. In one aspect, the float 116 is arranged to enclose at least a portion of the removable shaft, as illustrated in FIG. 1. In one aspect, the float 116 may fully surround or enclose the removable shaft 108. In one aspect, the float 116 may be arranged to move in a direction perpendicular to the major axis 132 of the removable shaft 108. In one aspect, the float 116 may be in contact with the removable shaft 108 and/or the shaft head 110. Further, in an alternative aspect, the float 116 may be arranged vertically, perpendicular to the arrangement illustrated in FIG. 1. For example, the shaft head 110, and hence the removable shaft 108, may be inserted into the housing from an opening (not shown) at the top of the housing 102 (where the one or more openings 112 are shown). The float 116 may then be arranged to move up or down along the removable shaft 108 arranged perpendicular to the major axis 132. In this example, the float 116 may be blocked from rising beyond a predetermined height or position by the shaft head 110 or by intermediate obstructs (not shown) on an external surface of the removable shaft 108, blow the shaft head 110. In this respect, various aspects of the present disclosure are not limited to the orientation illustrated in FIG. 1. Rather, one of ordinary skill in the art, in view of this disclosure, will understand and may contemplate other orientations (e.g., vertical or horizontal) of the float 116 and the removable shaft 108 with the shaft head 110. In one aspect, the first magnet 114 is optional. and may not be present. The switch 104 may then be substantially free of any magnetic field initially, and may be in a first state in the absence of any such magnetic field.

In one aspect, the float 116 includes the second magnet 118. The second magnet 118 is arranged to have a polarity opposite to that of the first magnet 114. The opposite polarity of the second magnet 118 with respect to the first magnet 114 is indicated by the letters 'N' and 'S' referring to the north pole and the south pole, respectively, of the second magnet 118. It is noted that the aspects of the disclosure are not dependent upon or limited by the individual polarity of the second magnet 118, rather on the relative polarity with respect to the first magnet 114 in the removable shaft 108. In one aspect, the second magnet 118 is a bar magnet. In one aspect, the second magnet 118 may be an array of magnets, e.g., an array of individual bar magnets, having an effective polarity similar to that for the second magnet 118 in FIG. 1. In one aspect, the second magnet 118 is substantially of equal size and strength as the first magnet 114. In one aspect, the second magnet 118 is arranged to lie at a bottom most portion of the float 116 under the influence of gravity. For example, when there is no fluid inside the volume 128, by virtue of its weight, the second magnet 118 causes the float to contact the removable shaft 108. In this example, the second magnet 118 lies at a distance farthest from any other portion of the float 116, as discussed with respect to FIGS. 2-3. In one aspect, the second magnet 118 is parallel to the first magnet 114 while maintaining the opposite polarity at the same time. Such parallelism may be, for example, with respect to the major axis 132 of the removable shaft 108, which both the first magnet 114 and the second magnet 118 are parallel to. Other variations and deviations from such parallel orientations of the first magnet 114 and the second magnet 118 may be contemplated by one of ordinary skill in the art in view of the present disclosure, as long as the features and functionality in various aspects of the present disclosure is maintained. For example, orientations of the first magnet 114 and the second magnet 118 may be almost parallel or slightly angular as long as the first magnet 114 and the second magnet 118 can cancel their respective magnetic fields when brought closer to change a state of the switch 104.

FIGS. 2 and 3 illustrate a cross-sectional view of the housing 102 along lines II-II in FIG. 1. FIG. 2 illustrates a relative position of the first magnet 114 and the second magnet 118 in a first state of the switch 104. FIG. 3 illustrates a relative position of the first magnet 114 and the second magnet 118 in a second state of the switch 104. It is to be noted that although two such relative positions of the first magnet 114 and the second magnet 118 are illustrated in FIGS. 2 and 3, other positions, e.g., positions intermediate or beyond the two relative positions shown in FIGS. 2 and 3 may exist, as may be understood by one of ordinary skill in the art in view of this disclosure. For example, the float 116 may be in between the positions shown in FIGS. 2 and 3 for the fluid levels $L_1$ and $L_2$.

Referring to FIG. 2, the float 116 is shown resting from and in contact with a portion of the removable shaft 108, although in one aspect, the float 116 may not be directly contacting the removable shaft 108. Such a position of the float 116 may occur when a fluid level $L_1$ exists in the volume 128 of the housing 102. In this example, the first magnet 114 and the second magnet 118 are separated by a first distance 202 along a first exemplary direction (e.g., the Y-Y axis, as indicated in FIG. 2). Due to the effect of gravity and the weight of the second magnet 118, the second magnet 118 is at a lowest portion of the float 116. In this respect, the point level float switch 100 is orientation independent. That is, no matter where the float 116 is, the second magnet 118 will always remain at the lowest portion of the float 116. Further, the second magnet 118 will always remain below the first magnet 114 with respect to the Y-Y axis. For example, since gravity acts downwards and if the direction of the gravitational force vector is considered as pointing towards the negative Y-Y axis, then a height at which the second magnet 118 is positioned at any time is always less than the height at which the first magnet 114 is positioned. In the relative position of the first magnet 114 and the second magnet 118, as illustrated in FIG. 2, the switch 104 is in a first state. For example, the switch 104 may be may be in an "OFF" state or an open state with the element 106 disconnecting the output terminals 130. In an alternative aspect (not shown), when a fluid in the volume 128 of the housing 102 is at the fluid level $L_1$, the switch 104 may be in an "ON" state or a closed state with the element 106 connecting the output terminals 130. When the first magnet 114 and the second magnet 118 are at the first distance 202, as illustrated in FIG. 2, the respective magnetic fields of the first magnet 114 and the second magnet 118 do not substantially interact. In this relative position of the first magnet 114 and the second magnet 118 illustrated in FIG. 2, the switch 104 is biased only by the magnetic field of the first magnet 114. Such biasing may determine the first state or the initial state of the switch 104 when the fluid in the volume 128 is at the fluid level $L_1$.

Referring to FIG. 3, the float 116 is at a higher position than the position shown in FIG. 2, with the second magnet 118 closer to the removable shaft 108. The float 116 may move to the position shown in FIG. 3 as a result of the fluid rising to a fluid level $L_2$ inside the volume 128. In this position of the float 116, the first magnet 114 and the second magnet 118 are separated by a distance 302 along the first exemplary direction (e.g., the Y-Y axis, as indicated in FIGS. 2 and 3). As discussed, due to the effect of gravity or the weight of the second magnet 118, the second magnet 118 is still at a lowest portion of the float 116. The arrangement of the float 116 and the removable shaft 108 causes the second magnet 118 to still stay below the first magnet 114, although the first magnet 114 and the second magnet 118 are closer to each other than in FIG. 2. That is, the second distance 302 is less than the first distance 202. Regardless of the orientation of the float 116 and the removable shaft 108, the first magnet 114 and the second magnet 118 are oppositely polarized. Such opposite polarity of the first magnet 114 and the second magnet 118 causes a cancellation of the magnetic field around the switch 104 resulting in the switch 104 changing to a different state (or, a second state) than that in FIG. 2. For example, the "OFF" or open state of the switch 104 may change to an "ON" state or a closed state with the element 106 connecting the output terminals 130. Such a connection of the element 106 may provide an output signal (electrical, acoustic, optical, or combinations thereof) indicating that the fluid level $L_2$ has been achieved inside the volume 128, or inside a tank in which the housing 102 is placed or inserted. A change in the state of the switch 104 may occur as the second magnet 118 is pulled in or attracted towards the first magnet 114 due to their relative opposite polarity, as discussed. Likewise, when the fluid level drops back towards the fluid level $L_1$, the float 116 may move back towards the position shown in FIG. 2, and the switch 104 may again change state, back to the state in FIG. 1. In one aspect, when the first magnet 114 is absent, the second magnet 118 may affect the state of the switch 104 and change the state of the switch 104 based on the location where the second magnet 118 is placed.

Figure 5:
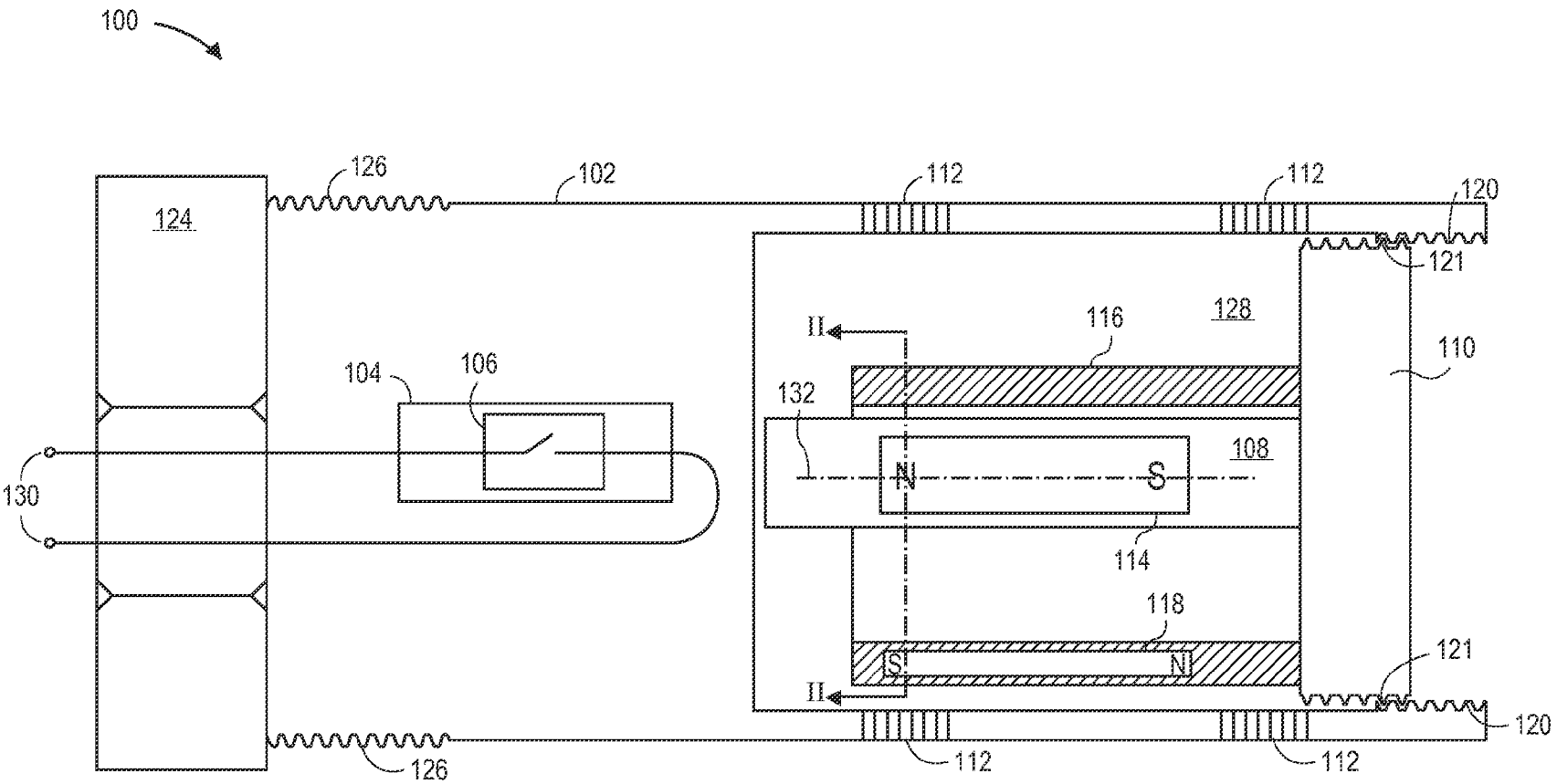
FIGS. 5 and 6 illustrate two exemplary arrangements showing orientation independence of the point level float switch of FIG. 1, in accordance with an aspect of the disclosure.
Figure 6:
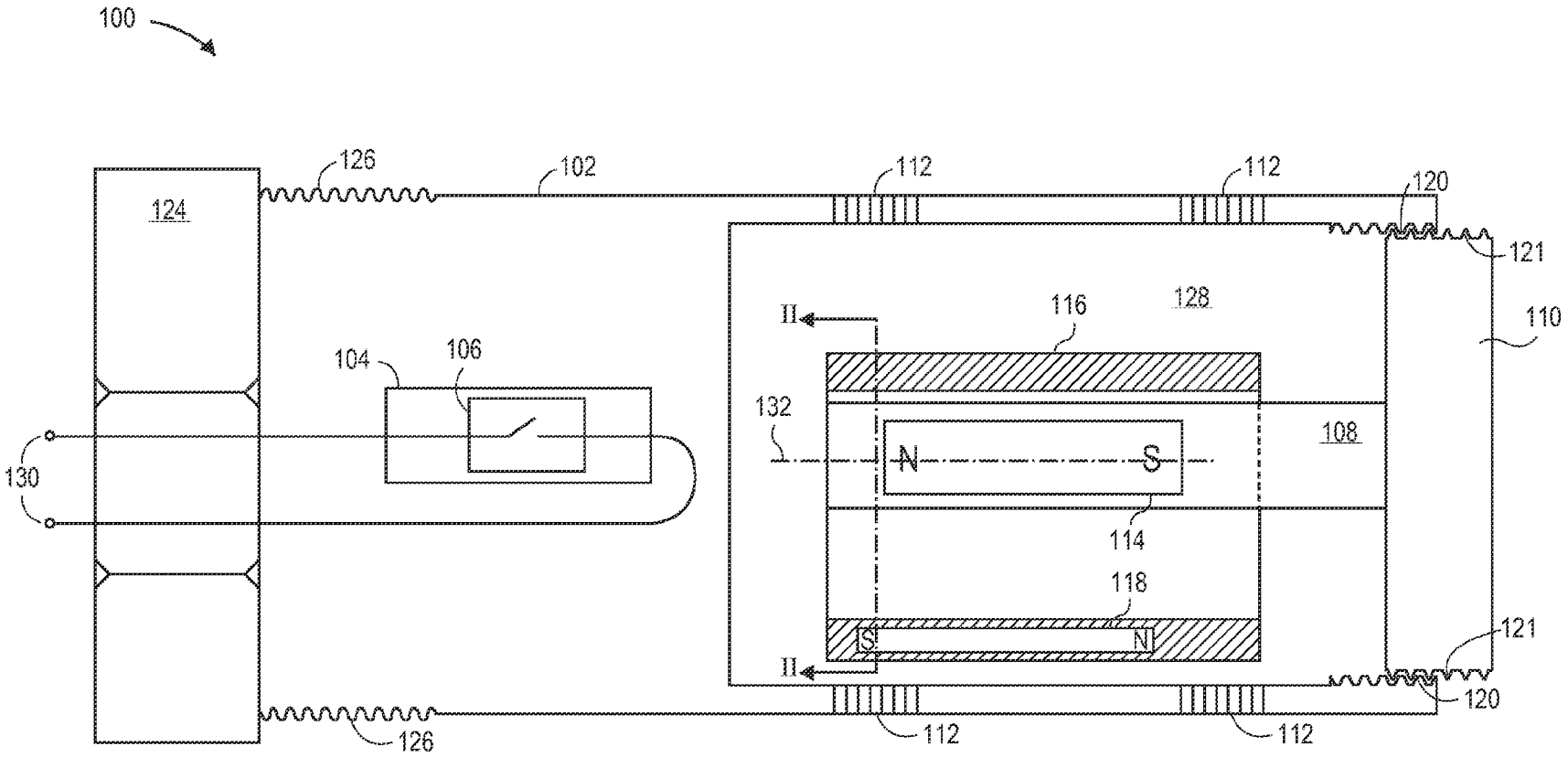

Referring to FIGS. 5 and 6, two exemplary arrangements showing orientation independence of the components of the point level float switch 100 of FIG. 1, in accordance with an aspect of the disclosure, are illustrated. In conventional float switches, the conventional float has to be precisely arranged in a specific orientation. Typically, a wrench is used to manually tighten the conventional float to a final position. However, due to the manual nature of the application of force, the conventional float switch is erroneously positioned and its operation is orientation dependent with respect to a magnet in the conventional float switch. FIG. 5 illustrates the shaft head 110 of the removable shaft 108 to be in a position where the third set of threads 121 overshoot the second set of threads 120 and have an orientation that is "over-screwed", for example, due to excessive application of force in installing the housing 102. Likewise, FIG. 6 illustrates the shaft head 110 of the removable shaft 108 to be in a position where the third set of threads 121 undershoot, or do not overshoot, the second set of threads 120 and have an orientation that is "under-screwed", for example, due to less than optimum application of force in installing the housing 102. In both the orientations illustrated in FIGS. 5 and 6, the float 116 is still in the same operating position independent of how far into the volume 128, or at what angle with respect to the major axis 132 or the housing 102, the removable shaft 108 is positioned or oriented. As a result of such orientation independence, precise manufacturing steps for the point level float switch 100 are not needed, or the number of such steps are reduced. It is to be noted that although two exemplary orientations of the removable shaft 108 with respect to the float 116 are illustrated in FIGS. 5 and 6, other different orientations of the housing 102, the removable shaft 108, and/or the float 116 may exist, as may be contemplated by one of ordinary skill in the art in view of this disclosure. For example, the removable shaft 108 may be positioned at locations other than those shown in FIGS. 1, 5, and 6, with respect to float 116. The term "orientation independent" or "orientation independence" may relate to the float 116 being in the same orientation, e.g., with respect to the switch 104 or the housing 102, independent of the positioning of the removable shaft 108. In one aspect, as discussed, the weight of the second magnet 118 causes the float 116 to orient in the same direction every time the point level float switch 100 is installed, for example, in an oil tank. Such orientation independence of the point level float switch 100 makes it more tolerant to installation errors (human or machine induced) and does not require precise positioning of the switch with respect to the float 116.

INDUSTRIAL APPLICABILITY

Figure 4:
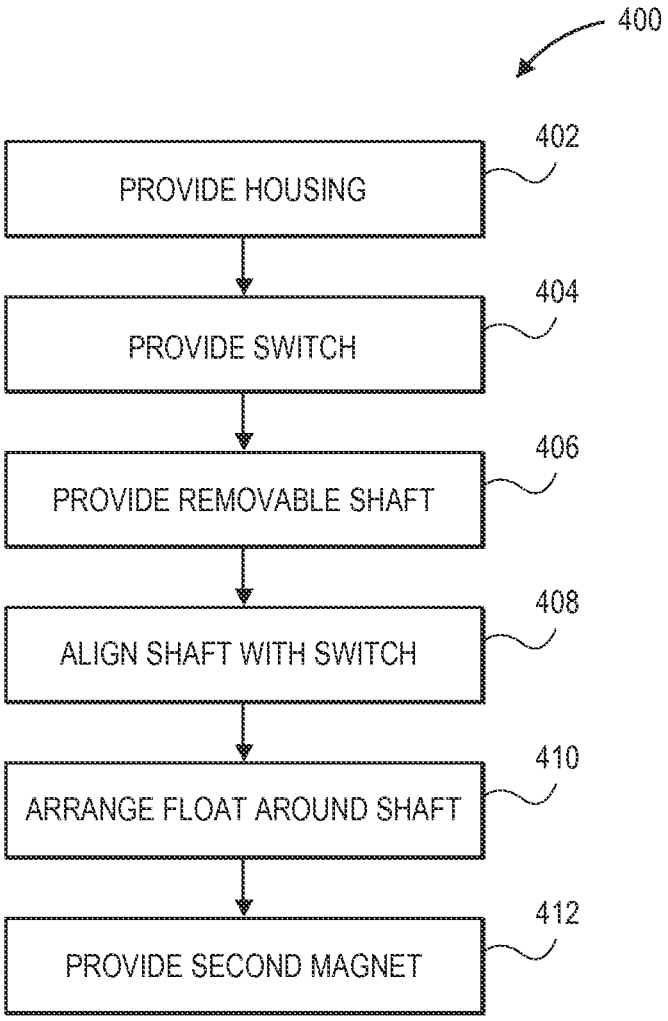
FIG. 4 illustrates a method of making or arranging the point level float switch of FIG. 1, in accordance with an aspect of the disclosure.

Various aspects of the present disclosure are applicable to generally to fluid level detection, and more particularly to making or providing the point level float switch 100 for passively detecting point level of a fluid using. FIG. 4 presents a flowchart of a process or method 400 for making the point level float switch 100. Conventionally, float switches move rotationally or angularly around a hinge to magnetically activate or deactivate a level detector switch. Such rotational motion occurs over a large sweep space and is prone to wear and tear of the hinge at which a float may be pivoted. The wear and tear is more at higher temperatures or harsh environments where such float switches may be deployed (e.g., in a mining dozer). Conventionally, active electronic sensors may be deployed in such fluid level detection systems. However, such active electronic sensors too are prone to errors in harsh environments, are more expensive than passive detectors, and are more complex to design, operate and maintain. The aspects of the present disclosure overcome these drawbacks.

One or more processes of the method 400 of may be skipped or combined as a single process, repeated several times, and the flow of operations in the method 400 may be in any order not limited by the specific order illustrated in FIG. 4. For example, various operations may be moved around in terms of their respective orders, or may be carried out in parallel with one or more other operations. Further, the functioning of the point level float switch 100 is not affected by an order in which the aspects discussed in FIGS. 2 and 3 are implemented, and such an order of implementation is by way of example only and not by way of limitation.

The method 400 may begin in an operation 402 where the housing 102 is provided. As discussed, providing the housing 102 may include providing the first set of threads 126 to screw in the housing 102 into a tank or a container (not shown) whose fluid level is to be monitored or detected. The housing 102 may be screwed into such a tank or container using the head 124 to rotate in the housing 102. The housing 102 includes the second set of threads 120 to screwably receive the removable shaft 108 via the corresponding complementary third set of threads 121. In one aspect, the operation 402 includes providing at least one opening (e.g., the one or more openings 112) in the housing 102 for receiving the fluid. The fluid(s) may enter or leave the housing 102 to or from the one or more openings 112.

In an operation 404, the switch 104 may be provided. In one aspect, the switch 104 is provided inside the housing 102, as discussed with respect to FIGS. 1-3. For example, the switch 104 may be provided inside the housing 102 prior to the housing 102 being used for detecting fluid level according to the various aspects of this disclosure. The switch 104 may be provided to operate in a manner such that the first magnet 114 can bias the switch 104, e.g., along an axis of the switch 104 or the element 106.

In an operation 406, the removable shaft 108 is provided. The removable shaft 108 has the shaft head 110 on which the third set of threads 121 having a thread pattern for screwing the removable shaft 108 into the housing 102 are provided. In one aspect, the third set of threads 121 are matched up with the second set of threads 120 on the housing 102. For example, at an entrance to the volume 128, the removable shaft 108 is inserted until the second set of threads 120 and the third set of threads 121 are in contact. Upon contact, the shaft head 110 may be turned in an appropriate direction (clockwise or anti-clockwise) around the major axis 132 depending on the thread pattern of the second set of threads 120 and the third set of threads 121. Such rotation of the shaft head 110 causes the removable shaft 108 to move closer or farther from the switch 104. Accordingly, a position of the removable shaft 108, and hence the first magnet 114 may be adjusted. In one aspect, providing the removable shaft 108 may include providing the first magnet 114 embedded in the removable shaft 108. For example, the position of the first magnet 114 may be fixed inside the removable shaft 108. Once the removable shaft 108 has been inserted into the volume 128 of the housing 102, the fixed first magnet 114 may be aligned with the switch 104 to bias the switch 104. Such alignment of the first magnet 114 may be carried out by adjusting the position of the removable shaft 108 in a screw-like motion aided by the second pair of threads 120 and the third pair of threads 121.

In an operation 408, aligning the first magnet 114 inside the removable shaft 108 with the switch 104 is carried out. In one aspect, such aligning of the first magnet 114 with a center line of the switch 104 may be carried out by adjusting the removable shaft 108 using the third set of threads 121 in a counter clockwise or clockwise motion, as discussed to calibrate the point level float switch 100. In one aspect, an alignment of the switch 104 and the first magnet 114 in to the removable shaft 108 can be achieved using a plastic/rubber carrier or insert (not shown). Calibration may be achieved by adjusting the removable shaft 108 so that the resistance reading from the switch 104 is less than one ohm, by way of example only, as other resistance values may be used.

In an operation 410, the float 116 is arranged to enclose at least a portion of the removable shaft 108. The operation 410 may include arranging the float 116 in contact with the removable shaft 108 when the switch 104 is in a closed state, as discussed with respect to FIG. 2. In one aspect, the float 116 may be provided to not be in contact with the removable shaft 108, depending upon a fluid level (e.g., fluid levels $L_1$ sand $L_2$) in the volume 128 of the housing 102. In one aspect, arranging the float 116 may include providing a partially hollow barrel as a part of the float 116. The removable shaft 108 may be enclosed by the hollow barrel shaped float 116. Such a hollow barrel is made of buoyant material configured to float on the fluid entering the volume 128 of the housing 102 and accordingly move the float 116 vertically up or down between the two positions shown in FIGS. 2 and 3. In one aspect, the float 116 is provided to be orientation independent with respect to the removable shaft 108. As discussed with respect to FIGS. 5 and 6, the float 116 always remains in a position where vertical movement (movement perpendicular to, or substantially perpendicular to, the major axis 132) of the float 116 with respect to changing levels of fluid in the volume 128 occurs. That is, the arranging of the float 116 is carried out in an orientation independent manner with respect to the removable shaft 108.

In an operation 412, the second magnet 118 having a polarity opposite to that of the first magnet 114 is provided in the float 116. The second magnet 118 is arranged inside the float 116 in a manner such that the second magnet 118, under gravity, is arranged at a lowest portion of the float 116 below the first magnet 114. In one aspect, providing the second magnet 118 includes providing the second magnet 118 at the first distance 202 from the first magnet 114 for the closed state of the switch 104. In one aspect, providing the second magnet 118 includes providing the second magnet 118 at the second distance 302 from the first magnet 114 when the switch 104 is in a first state (e.g., an open state), the second distance 302 between the first magnet 114 and the second magnet 118 being less than the first distance 202. In one aspect, the providing the second magnet 118 includes arranging the second magnet 118 parallel to the first magnet 114 but with opposite polarity. When the float 116 moves as a result of a rising fluid level in the volume 128, the second magnet 118 comes closer to the removable shaft 108 and hence to the first magnet 114. The closer distance between the first magnet 114 and the second magnet 118 cancels the bias magnetic field being applied to the element 106 of the switch 104, and changes the state of the switch 104. Such change in the state of the switch 104 causes the switch 104 to output a signal on the output terminals 130 indicating that the fluid level has reached a certain point (e.g., the fluid level $L_2$). In one aspect, the second magnet 118 may be provided of substantially equal dimensions or size as the first magnet 114. In one aspect, the second magnet 118 may be provided of substantially equal magnetic strength.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A point level float switch, comprising:

a switch;

a removable shaft including an axis, and a first magnet aligned with the switch; and a float arranged to enclose at least a portion of the removable shaft, the float including a second magnet of a polarity opposite to the first magnet and arranged parallel to the first magnet in the removable shaft, wherein the float is configured to move in a direction perpendicular to the axis of the removable shaft.

2. The point level float switch of claim 1, wherein the second magnet is located at a first distance below the first magnet when the switch is in a first state and located at a second distance below the first magnet when the switch is in a second state.

3. The point level float switch of claim 1 further comprising:

a housing including threads configured to screwably receive the removable shaft.

4. The point level float switch of claim 3, wherein the housing includes at least one opening arranged to receive a fluid, said float arranged to move linearly in a direction perpendicular to a major axis of the removable shaft as a fluid level in the housing changes.

5. The point level float switch of claim 1, wherein the first magnet is aligned fixed relative to the switch along a center line of the switch.

6. The point level float switch of claim 1, wherein the first and the second magnets are substantially equal in size and magnetic strength.

7. The point level float switch of claim 1, wherein the float is in contact with the removable shaft when the switch is in a closed state, the second magnet being at a first distance from the first magnet for the closed state of the switch, and wherein the second magnet is at a second distance from the first magnet when the switch is in an open state, the second distance being less than the first distance.

8. The point level float switch of claim 1, wherein the float is a partially hollow barrel surrounding the removable shaft such that the second magnet, under gravity, is arranged at a lowest portion of the float below the first magnet.

9. The point level float switch of claim 1, wherein the removable shaft comprises a thread pattern arranged to attach or adjust a position of the removable shaft into a housing of the point level float switch, the housing including the switch.

10. A housing for a point-level float switch, the housing comprising:

a reed switch;

a screwable shaft having a first magnet embedded therein and aligned with the reed switch, the screwable shaft also having an axis; and a float arranged to enclose at least a portion of the screwable shaft, the float including a second magnet of a polarity opposite to the first magnet and arranged parallel to the first magnet in the screwable shaft, wherein the float is configured to move in a direction perpendicular to an axis of the screwable shaft.

11. A method of making a point level float switch, the method comprising:

providing a switch;

aligning with the switch, a first magnet inside a removable shaft;

arranging a float enclosing at least a portion of the removable shaft, wherein the float is configured to move in a direction perpendicular to an axis of the removable shaft; and providing a second magnet of a polarity opposite to the first magnet inside the float, the first and the second magnets being parallel.

12. The method of making the point level float switch according to claim 11, wherein the providing the second magnet comprises locating the second magnet at a first distance below the first magnet when the switch is in a closed state.

13. The method of making the point level float switch according to claim 11 further comprising:

providing a housing including threads configured to screwably receive the removable shaft.

14. The method of making the point level float switch according to claim 13, wherein providing the housing comprises:

providing at least one opening in the housing for receiving a fluid, said float arranged to move linearly in a direction perpendicular to a major axis of the shaft as a fluid level of the fluid in the housing changes.

15. The method of making the point level float switch according to claim 11, wherein the aligning comprises aligning the first magnet in a fixed position relative to the switch along a center line of the switch.

16. The method of making the point level float switch according to claim 11, wherein the arranging the float is carried out in an orientation independent manner with respect to the removable shaft.

17. The method of making the point level float switch according to claim 11, wherein the arranging the float comprises arranging the float in contact with the removable shaft when the switch is in a closed state, and wherein the providing the second magnet comprises providing the second magnet at a first distance from the first magnet for the closed state of the switch, and providing the second magnet at a second distance from the first magnet when the switch is in an open state, the second distance being less than the first distance.

18. The method of making the point level float switch according to claim 11, wherein the arranging the float comprises providing a partially hollow barrel surrounding the removable shaft such that the second magnet, under gravity, is arranged at a lowest portion of the float below the first magnet.

19. The method of making the point level float switch according to claim 11 further comprising:

providing a thread pattern on the removable shaft for screwing the removable shaft into the housing.

20. The method of making the point level float switch according to claim 19 further comprising:

adjusting the removable shaft using the thread pattern.

* * * * *